US009290949B2

(12) United States Patent
Choy

(10) Patent No.: US 9,290,949 B2
(45) Date of Patent: Mar. 22, 2016

(54) SEALING STRIP AND FLOOR TILE UNIT

(71) Applicant: Yat Man Choy, Tsuen Wan (CN)

(72) Inventor: Yat Man Choy, Tsuen Wan (CN)

( * ) Notice: Subject to any disclaimer, the term of this patent is extended or adjusted under 35 U.S.C. 154(b) by 0 days.

(21) Appl. No.: 14/337,788

(22) Filed: Jul. 22, 2014

(65) Prior Publication Data

US 2015/0315800 A1 Nov. 5, 2015

(30) Foreign Application Priority Data

Apr. 30, 2014 (CN) ..... 2014 2 0221821 U

(51) Int. Cl.
*E04F 19/02* (2006.01)
*E04F 15/02* (2006.01)
*E04F 15/08* (2006.01)

(52) U.S. Cl.
CPC ..... *E04F 15/02016* (2013.01); *E04F 15/02194* (2013.01); *E04F 15/08* (2013.01)

(58) Field of Classification Search
CPC ..... E04F 15/02016; E04F 15/02033; E04F 15/02005; E04B 1/68
USPC ..... 52/390, 393, 394, 396.1
See application file for complete search history.

(56) References Cited

U.S. PATENT DOCUMENTS

| | | | | |
|---|---|---|---|---|
| 3,137,973 | A * | 6/1964 | Williams | 52/396.09 |
| 4,815,886 | A * | 3/1989 | Madsen | 403/28 |
| 4,817,963 | A * | 4/1989 | Munden et al. | 277/316 |
| 2008/0078135 | A1 * | 4/2008 | McIntosh et al. | 52/396.1 |
| 2012/0272597 | A1 * | 11/2012 | Hilburn, Jr. | 52/232 |

FOREIGN PATENT DOCUMENTS

WO WO 2013117553 * 2/2013

* cited by examiner

*Primary Examiner* — Charles A Fox
*Assistant Examiner* — Patrick Maestri
(74) *Attorney, Agent, or Firm* — Wilmer Cutler Pickering Hale and Dorr LLP

(57) ABSTRACT

The present invention discloses a sealing strip and a floor tile unit. The sealing strip has two edge strips intersecting each other. Each edge strip of the sealing strip is sandwiched in a gap between floor tiles and a gap between baseplates of the floor tile unit, ends of adjacent edge strips of adjacent sealing strips are connected with each other in both a gap between the adjacent baseplates and a gap between the adjacent floor tiles. With the reasonable structural arrangement of the sealing strip in the present invention, the sealing strip is easy to be assembled, the splicing in the floor tile unit is stable and reliable, and liquids and dust are prevented from permeating into gaps between adjacent floor tiles and gaps between the floor tiles at the intersection of the edge strips of the sealing strip.

4 Claims, 4 Drawing Sheets

SEALING STRIP AND FLOOR TILE UNIT

RELATED APPLICATION

The present application claims priority to Chinese application NO. 201420221821.3, filed Apr. 30, 2014, the content of which is expressly incorporated by reference in its entirety.

TECHNICAL FIELD

The present invention relates to the field of floor technologies, in particular, to a sealing strip and a floor tile unit.

TECHNICAL BACKGROUND

Traditional floor tiles are directly stuck on a ground laid with cement, which is demanding for flatness of the ground before the laying of the floor tiles, otherwise defective situations such as suspension and breakage of the floor tiles or obvious segment deviations or gaps between the floor tiles will occur due to the uneven ground or unevenly laying of the cement, as a result, a rework and corrections are necessary due to unsatisfying flatness of the floor surface formed by the laid floor tiles; moreover, processes are troublesome and plenty of materials would be wasted during the rework, so that wastes of manpower and material resources are likely caused. Furthermore, such a way of laying floor tiles cannot be flexibly adjusted at will according to individual needs, and professional workers have to be hired for such laying. In addition, liquids and dust are easy to permeate into the gaps between laid floor tiles, but are difficult to clean. In the prior art, there is a way of arranging a rubber strip in a gap between adjacent floor tiles, to relieve the above problems to a certain extent. However, gaps at an intersection of four spliced floor tiles cannot be effectively sealed tightly because the rubber strip is designed in a straight shape or an L shape. Therefore, the problem of liquids or dust permeating into the gaps still exists, and a phenomena such as decomposition and deformation of baseplates is likely caused.

SUMMARY

A first object of the present invention is to provide a sealing strip which has a reasonable structure, is easy to be mounted, and has a good sealing effect.

A second object of the present invention is to provide a floor tile unit which is stable and reliable in splicing, which prevents a liquid or dust from permeating into gaps between floor tiles arranged around an intersection of edge strips of a sealing strip.

For achieving above two objects, the present invention adopts following technical solutions:

a sealing strip, which has two edge strips intersecting each other. Each edge strip includes a support arm, and an elastic arm and a base arranged at top and bottom sides of the support arm, respectively. The base as well as the elastic arm extends symmetrically from both lateral sides of the support arm, and a width of the base is slightly greater than that of the elastic arm.

Both ends of the elastic arm warp upward, and the elastic arm is integrally formed with the support arm and the base by double-color injection molding.

Both ends of the elastic arm are provided with flat surfaces for closely abutting against abutting faces at both sides of the elastic arm.

A bottom surface of the base is provided with a suction layer for fastening to a bottom abutting surface, and a middle portion of the suction layer concaves upward.

A bottom of the base is provided with a clamping hole for fastening to a bottom abutting surface, and the clamping hole is arranged just below the support arm.

A floor tile unit including above sealing strip, wherein, a floor tile unit includes a baseplate layer formed by a plurality of baseplates having the same structure. Floor tiles are laid on the top of the baseplate layer. Each edge strip of the sealing strip is configured to be sandwiched in a gap between the floor tiles and a gap between the baseplates of the floor tile unit, and ends of adjacent edge strips of adjacent sealing strips are connected with each other in both a gap between the adjacent baseplates and a gap between the adjacent floor tiles. The elastic arm is sandwiched in the gap between the adjacent floor tiles, and the base is sandwiched in the gap between overlapped adjacent baseplates. A top surface of the base is slightly higher than that of the baseplate.

The support arms at ends of adjacent edge strips of adjacent sealing strips are correspondingly provided with a first recess and a first protrusion, respectively, for connecting adjacent sealing strips closely, and the first recess and the first protrusion match with each other.

Top and right sides at an upper surface of the baseplate are concave downward to form an upper overlapping edge, bottom and left sides at a lower surface of the baseplate are concave upward to form a lower overlapping edge. The upper overlapping edge of one of adjacent baseplates and the lower overlapping edges of the other of adjacent baseplates match with each other, and the base is accommodated in a gap between the upper overlapping edge and the lower overlapping edge.

Abutting surfaces of the upper overlapping edge and the lower overlapping edge are correspondingly and respectively provided with a second bump and a second recess which are configured for snap fitting with each other.

The sealing strip and the upper overlapping edge match with each other, and the sealing strip is integrally formed with the baseplate by injection molding.

Beneficial effects of the present invention lie in that: the sealing strip in the present invention has two edge strips intersecting each other, each edge strip of the sealing strip is sandwiched in a gap between floor tiles and a gap between baseplates of the floor tile unit, ends of adjacent edge strips of adjacent sealing strips are connected with each other in both a gap between adjacent baseplates and a gap between the adjacent floor tiles, an elastic arm is sandwiched in the gap between the adjacent floor tiles, and the base of the sealing strip is sandwiched in the gap between the overlapped adjacent baseplates; the sealing strip having two edge strips intersecting each other makes floor tiles, which are arranged around the intersection of the two edge strips of the sealing strip, closely abut against each other through the elastic arm of the sealing strip, so that liquids and dust are prevented from permeating into gaps between the floor tiles at the intersection of the edge strips of the sealing strip; meanwhile, ends of adjacent sealing strips are connected with each other in both the gap between adjacent baseplates and the gap between adjacent floor tiles, so that connection between the sealing strips is tight and firm. With the reasonable structural arrangement of the sealing strip in the present invention, the sealing strip is easy to be assembled, the splicing in the floor tile unit in the present invention is stable and reliable, and liquids and dust are prevented from permeating into gaps between adjacent floor tiles.

Figure 1:
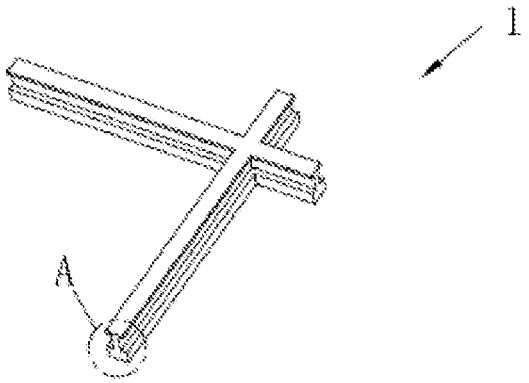
FIG. 1 is an isometric view of a sealing strip according to the present invention.
Figure 2:
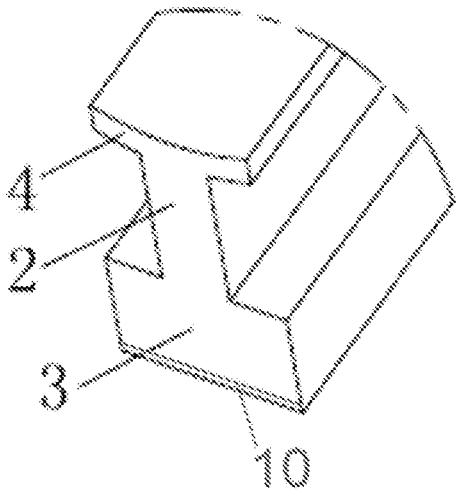
FIG. 2 is a partial enlarged view of portion A in FIG. 1.
Figure 3:
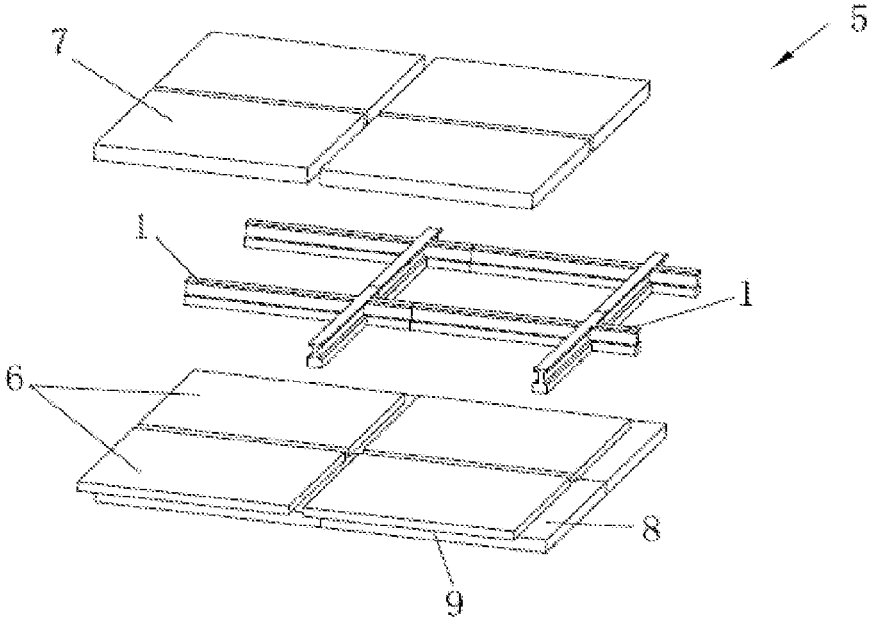
FIG. 3 is a schematic exploded view of a floor tile unit.
Figure 4:
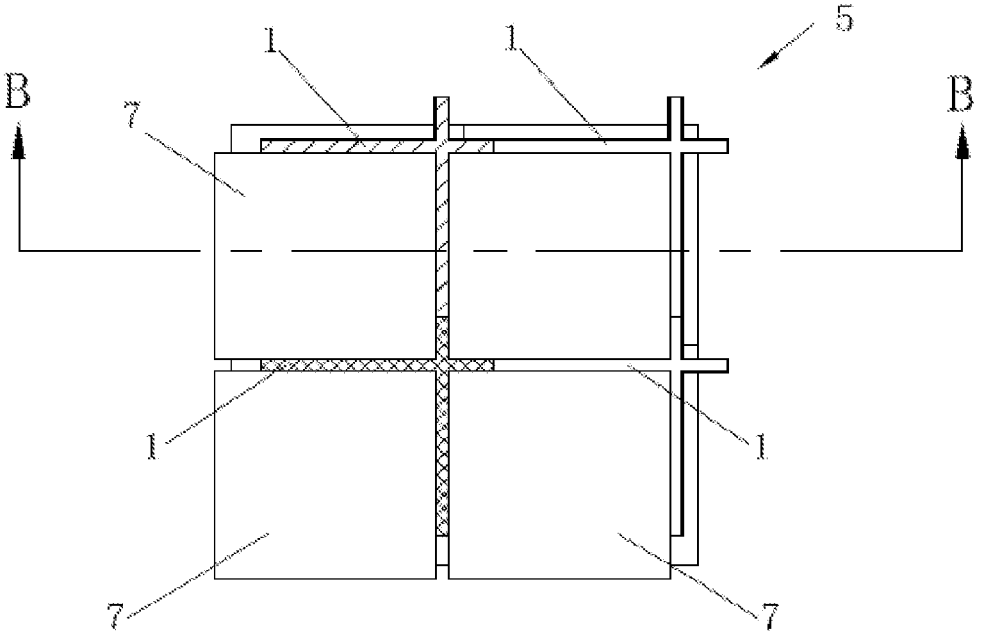
FIG. 4 is a front view of the floor tile unit.
Figure 5:
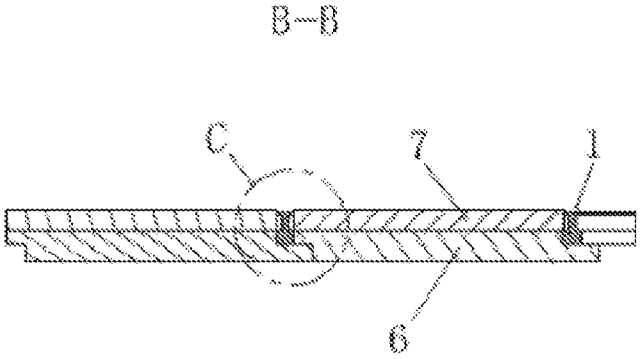
FIG. 5 is a sectional view of section B-B in FIG. 4.

A list of the reference numerals:

| | | | |
|---|---|---|---|
| 1: Sealing Strip; | 2: Support Arm; | 3: Base; | 4: Elastic Arm; |
| 5: Floor Tile Unit; | 6: Baseplate; | 7: Floor Tile; | |
| 8: Upper Overlapping edge; | 9: Lower Overlapping edge; | 10: Suction Layer; | |
| 11: Clamping Hole; | 12: First Recess; | 13: First Protrusion | |
| 14: Second Protrusion; | 15: Second Recess. | | |

DETAILED DESCRIPTION OF THE PREFERRED EMBODIMENT

Technical solutions of the present invention will be further described by way of specific embodiments in conjunction with the FIGS. 1 to 8.

As shown in FIG. 1, a sealing strip 1 has two edge strips intersecting each other. Each edge strip includes a support arm 2, and an elastic arm 4 and a base 3 arranged at top and bottom sides of the support arm 2, respectively. The base 3, as well as the elastic arm 4, extends symmetrically from both lateral sides of the support arm 2, and a width of the base 3 is slightly greater than that of the elastic arm 4. In an implementation of the present embodiment, the sealing strip 1 employed in the present invention is formed of two materials including injection-molded rubber and engineering plastic by double-color injection molding, where the elastic arm 4 of the sealing strip 1 is formed by the injection-molded rubber, and the support arm 2 and the base 3 are formed of the injection-molded engineering plastic. Both ends of the elastic arm 4 warp upward for the sake of closely abutting against floor tiles located at both sides of the elastic arm 4. Moreover, the support arm 2 and the base 3, which are formed of the engineering plastic by injection molding, can well position and support the elastic arm 4.

Both ends of the elastic arm 4 are provided with flat surfaces for closely abutting against abutting faces of floor tiles at both sides of the elastic arm 4. This structural configuration of the elastic arm 4 enables the elastic arm 4 to be in close contact with the floor tiles at both sides of the elastic arm when being pressed by the floor tiles, for the sake of seal and assemble.

A bottom surface of the base 3 is provided with a suction layer 10 for fastening to a bottom abutting surface, and a middle portion of the suction layer 10 concaves upward. In an implementation of the present invention, the bottom of the base 3 is designed as a suction layer with a suction effect, while the sealing strip in the present embodiment is formed by the above double-color injection molding, so that the base 3 is easy to stick to the bottom abutting surface, for the purpose of easy assemble and disassemble.

The bottom of the base 3 is provided with a clamping hole 11 for fastening to a bottom abutting surface, and the clamping hole 11 is arranged just below the support arm 2. Corresponding to this structural configuration, a bump is arranged on the bottom abutting surface matching the bottom of the base 3, to match with the clamping hole 11 to firmly mount the sealing strip.

Figure 6:
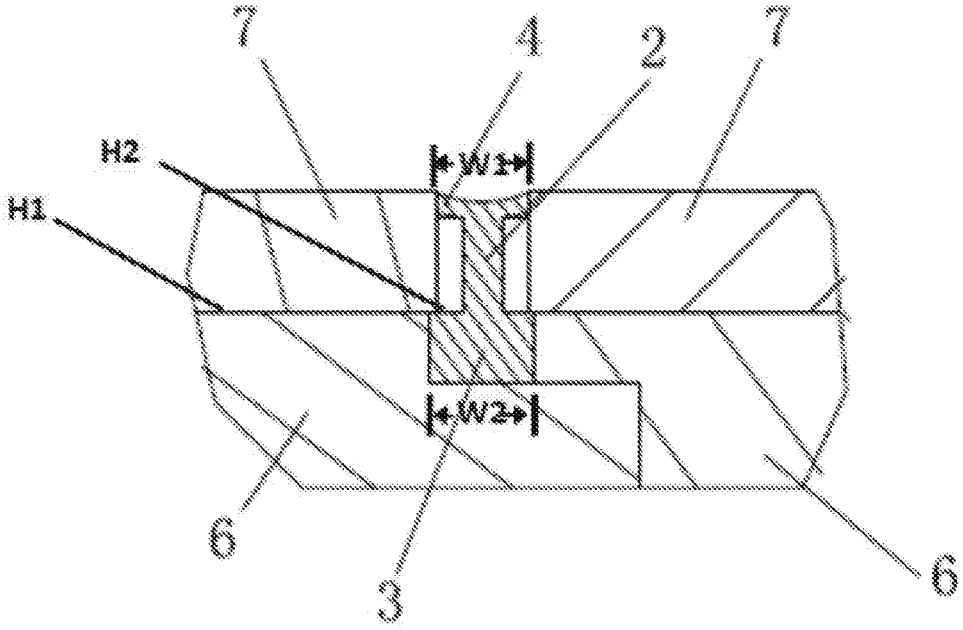
FIG. 6 is a partial enlarged view of portion C in FIG. 5.
Figure 7:
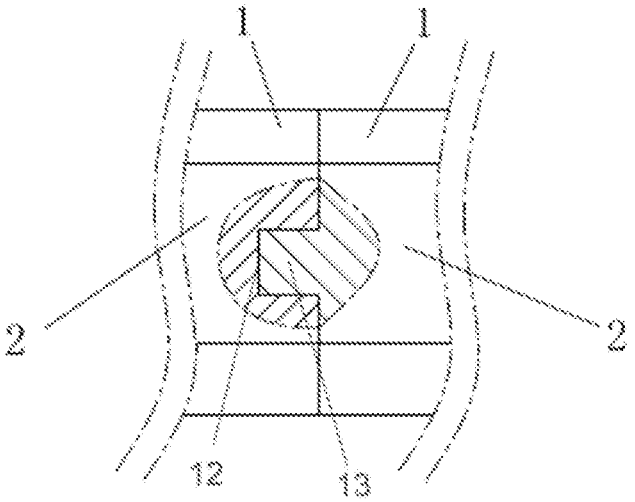
FIG. 7 is a schematic view of a structure at connected ends of adjacent edge strips of two sealing strips in FIG. 4.
Figure 8:
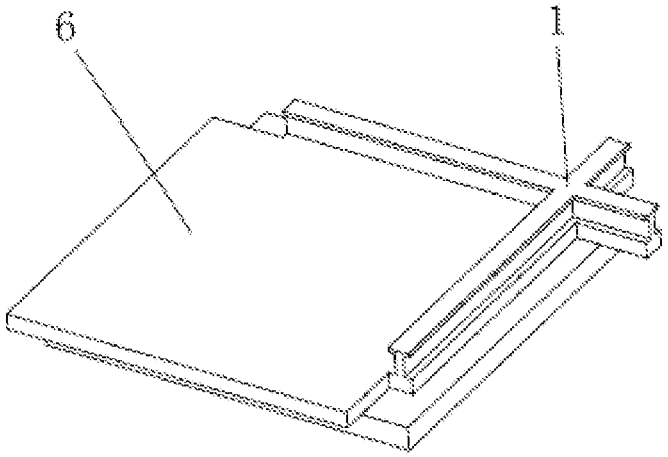
FIG. 8 is an isometric view of a baseplate and a sealing strip in FIG. 4 which are integrally formed.

The present invention further provides a floor tile unit 5 including the above sealing strip, and the floor tile unit 5 includes a baseplate layer formed by four overlapped baseplates 6 having the same structure. Four floor tiles 7 are laid on the top of the baseplate layer. Each edge strip of the sealing strip 1 is configured to be sandwiched in a gap between the floor tiles and a gap between the baseplates of the floor tile unit 5, and ends of adjacent edge strips of two sealing strips 1 are connected with each other in both a gap between the adjacent baseplates 6 and a gap between the adjacent floor tiles 7, where the elastic arm 4 is sandwiched in the gap between the adjacent floor tiles 7, and the base 3 is sandwiched in the gap between the overlapped adjacent baseplates 6. As shown in FIG. 6, a top surface of the base 3 (H2) is slightly higher than that of the baseplate 6 (H1). Additionally, a width of the base 3 (W2) is slightly greater than that of the elastic arm 4 (W1). The sealing strip having two edge strips intersecting each other makes floor tiles, which are arranged around the intersection of the two edge strips of the sealing strip, closely abut against each other through the elastic arm of the sealing strip, so that a liquid or dust is prevented from permeating into gaps between the floor tiles at the intersection of the edge strips of the sealing strip. Meanwhile, ends of adjacent edge strips of sealing strips are connected with each other in both the gap between the adjacent baseplates and the gap between the adjacent floor tiles, so that the connection between the sealing strips is tight and firm. With the reasonable structural arrangement of the sealing strip in the present invention, the sealing strip is easy to be assembled, the splicing in the floor tile unit in the present invention is stable and reliable, and a liquid or dust is prevented from permeating into gaps between adjacent floor tiles.

The support arms 2 at ends of adjacent edge strips of two sealing strips 1 are correspondingly provided with a first recess 12 and a first protrusion 13, respectively, for connecting the sealing strips 1 closely, where the first recess 12 and the first protrusion 13 match with each other. In an implementation of the present embodiment, in order for the ends of edge strips of adjacent sealing strips to be connected well with each other to prevent the permeation of liquids or dust in the present invention, end faces of adjacent support arms formed of engineering plastic are respectively provided with the first recess and the first protrusion closely matching with each other, so that the elastic arms at the top sides of the support arms are sufficiently closely attached to each other, and the permeation of a liquid or dust at the connecting location of two sealing strips is prevented.

Top and right sides at an upper surface of the baseplate 6 are concave downward to form an upper overlapping edge 8, and bottom and left sides at a lower surface of the baseplate 6 are concave upward to form a lower overlapping edge 9. The upper overlapping edge 8 of one of adjacent baseplates 6 matches with the lower overlapping edge 9 of the other of the adjacent baseplates 6, and the base 3 may be accommodated in a gap between the upper overlapping edge 8 and the lower overlapping edge 9. This structural configuration makes the base be fixed easily. Meanwhile, since the base is slightly higher than an upper surface of the baseplate, floor tiles arranged at both lateral sides of the support arm of a sealing strip can tightly press the base while pressing the elastic arm of the sealing strip, thus making the connections in the whole floor tile unit more stable and reliable.

Abutting surfaces of the upper overlapping edge 8 and the lower overlapping edge 9 are respectively and correspondingly provided with a second protrusion 14 and a second recess 15, which are configured for snap fitting with each other. This structural configuration makes a connection between baseplates stable and reliable, and processes such as adhesion with glue are omitted.

The sealing strip 1 and the upper overlapping edge 8 match with each other, and is integrally formed with the baseplate 6 by injection molding. In an implementation, the base of the sealing strip 1 is arranged on the upper overlapping edge 8, and the integral forming is adopted so that the sealing strip 1 and the baseplate 6 form an entirety. Floor tiles are arranged at both lateral sides of the support arm of the sealing strip and tightly press the elastic arm of the sealing strip after the base of the sealing strip is overlapped with the upper overlapping edge 8, thus making the assembly of the floor tile unit more rapid and connections in the whole floor tile unit more stable and reliable.

Technical principles of the present invention are described above in conjunction with specific embodiments. These descriptions are only used for explaining principles of the present invention but should not be construed as limiting the protection scope of the present invention in any way. Based on explanations here, those skilled in the art can conceive other specific embodiments of the present invention without paying inventive working. These specific embodiments would fall into the protection scope of the present invention.

The invention claimed is:

1. A floor tile unit (5) comprising:

a sealing strip having two edge strips intersecting each other, wherein each edge strip comprises a support arm (2), and an elastic arm (4) and a base (3) arranged at top and bottom sides of the support arm (2), respectively, the base (3) as well as the elastic arm (4) extends symmetrically from both lateral sides of the support arm (2), and a width of the base (3) is greater than that of the elastic arm (4); and a baseplate layer formed by a plurality of baseplates (6) having the same structure, wherein floor tiles (7) are laid on the top of the baseplate layer; each edge strip of the sealing strip (1) is configured to be sandwiched in a gap between the floor tiles and a gap between the baseplates of the floor tile unit (5), and ends of adjacent edge strips of adjacent sealing strips (1) are connected with each other in both a gap between the adjacent baseplates (6) and a gap between the adjacent floor tiles (7); the elastic arm (4) is sandwiched in the gap between the adjacent floor tiles (7), and the base (3) is sandwiched in the gap between overlapped adjacent baseplates (6); a top surface of the base (3) is higher than that of the baseplate (6); the support arms (2) at ends of adjacent edge strips of adjacent sealing strips (1) are correspondingly provided with a first recess and a first protrusion, respectively, for connecting adjacent sealing strips (1) closely, and the first recess and the first protrusion match with each other.

2. The floor tile unit of claim 1, wherein, top and right sides at an upper surface of the baseplate (6) are concave downward to form an upper overlapping edge (8), bottom and left sides at a lower surface of the baseplate (6) are concave upward to form a lower overlapping edge (9), the upper overlapping edge (8) of one of adjacent baseplates (6) and the lower overlapping edge (9) of the other of the adjacent baseplates (6) match with each other, and the base (3) is accommodated in a gap between the upper overlapping edge (8) and the lower overlapping edge (9).

3. The floor tile unit of claim 2, wherein, abutting surfaces of the upper overlapping edge (8) and the lower overlapping edge (9) are correspondingly and respectively provided with a second protrusion and a second recess which are configured for snap fitting with each other.

4. The floor tile unit of claim 3, wherein, the sealing strip (1) and the upper overlapping edge (8) match with each other, and the sealing strip (1) is integrally formed with the baseplate (6) by injection molding.

* * * * *